United States Patent [19]

Green

[11] 4,340,259

[45] Jul. 20, 1982

[54] WEAR BUSHING

[76] Inventor: James R. Green, 3823 Ridgelake, Apt. 223, Metairie, La. 70002

[21] Appl. No.: 209,718

[22] Filed: Nov. 24, 1980

[51] Int. Cl.[3] ..... F16C 31/02

[52] U.S. Cl. ..... 308/4 A; 308/15; 166/241

[58] Field of Search ..... 308/4 R, 4 A, 237 R, 308/15, 27; 166/241; 175/209, 210, 220

[56] References Cited

U.S. PATENT DOCUMENTS

| | | | |
|---|---|---|---|
| 433,990 | 8/1890 | Martin | 308/4 A |
| 712,887 | 11/1902 | Wyczynski | 308/4 A |
| 1,891,953 | 12/1932 | Sellars | 175/220 |
| 2,410,589 | 11/1946 | Segelhorst | 308/4 A |
| 2,465,425 | 3/1949 | Bower | 308/27 |
| 2,635,015 | 4/1953 | Babb | 308/15 |
| 2,758,818 | 8/1956 | Kammerer, Jr. | 308/4 A |
| 2,904,357 | 9/1959 | Knox | 286/16.1 |
| 3,421,580 | 1/1969 | Fowler et al. | 166/0.5 |
| 3,473,607 | 10/1969 | Castille | 308/4 R |
| 3,953,089 | 4/1976 | Dainin | 308/237 R |
| 4,098,341 | 7/1978 | Lewis | 166/314 |
| 4,154,448 | 5/1979 | Biffle | 277/31 |
| 4,157,186 | 6/1979 | Murray et al. | 277/31 |
| 4,186,973 | 2/1980 | Work | 308/4 A |

*Primary Examiner*—Richard R. Stearns

*Attorney, Agent, or Firm*—Guy E. Matthews; Leland D. Schultz

[57] ABSTRACT

A wear bushing is disclosed for use to protect the bowl within a casing head or tubing head during drilling operations. In addition to preventing damage from drill string members, means are disclosed to prevent damage to the bowl caused by high velocity flow of abrasive particles.

6 Claims, 7 Drawing Figures

FIG. 4
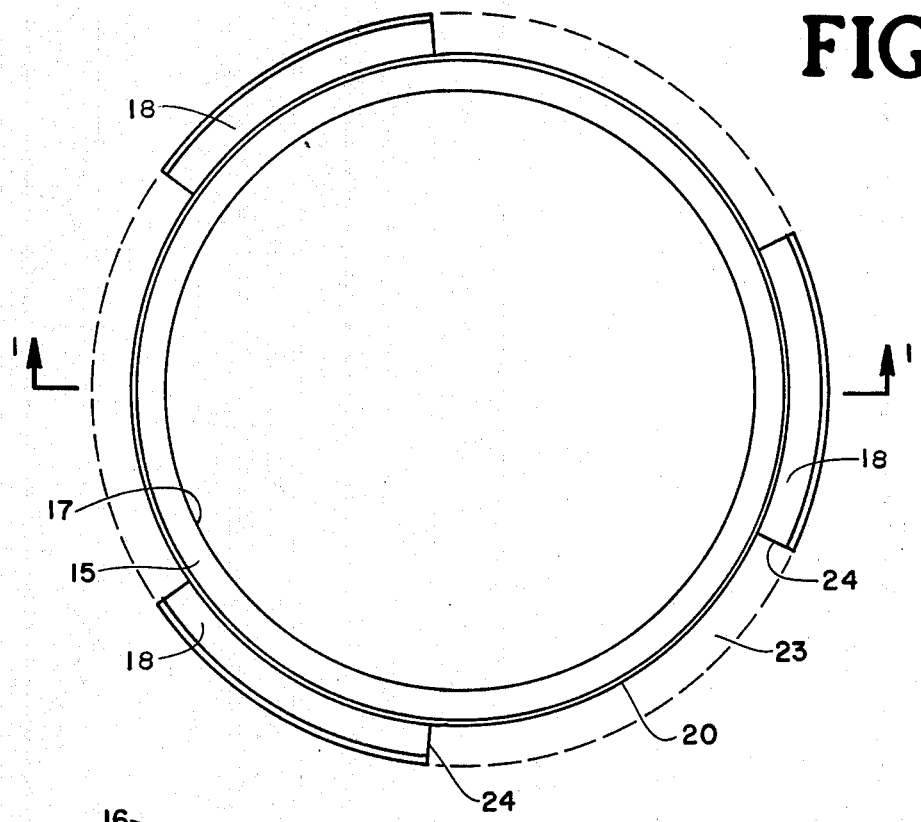
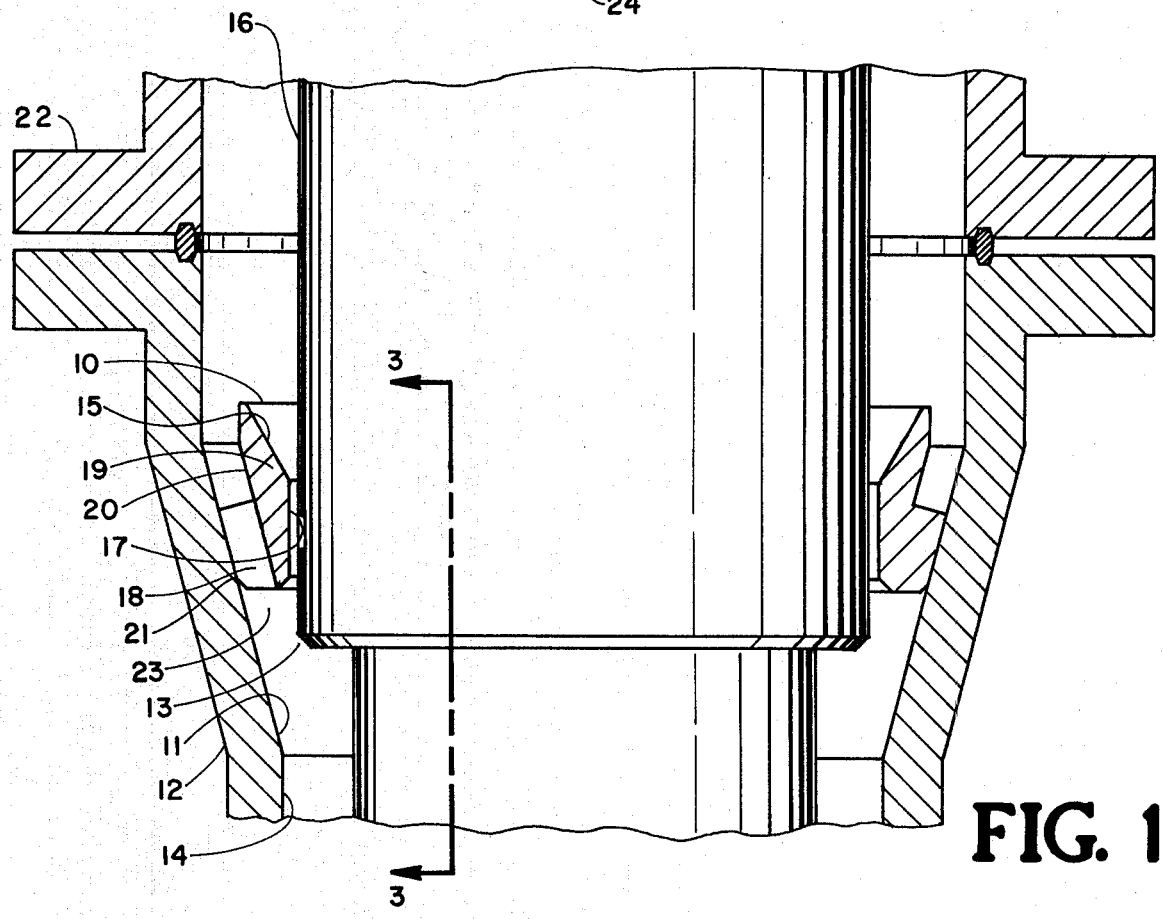
FIG. 1

FIG. 6
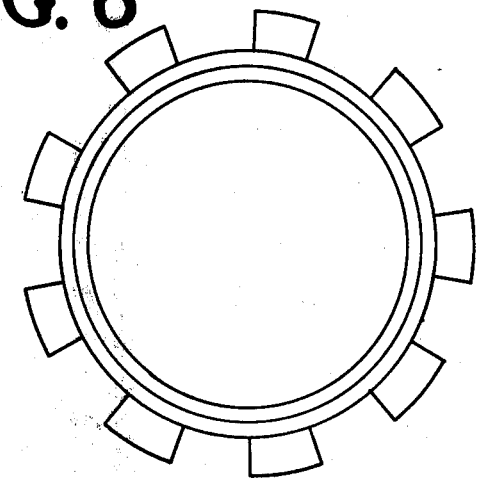
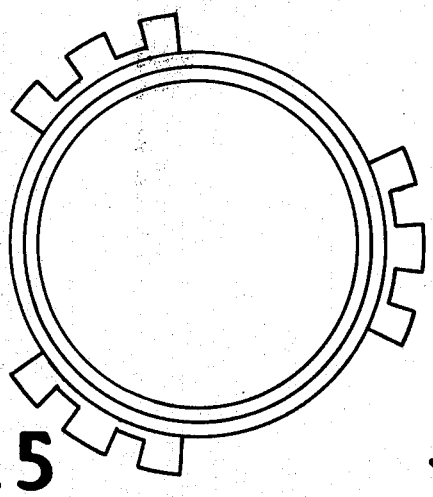
FIG. 5
FIG. 7
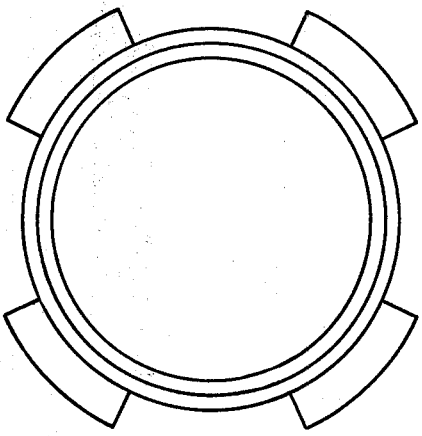
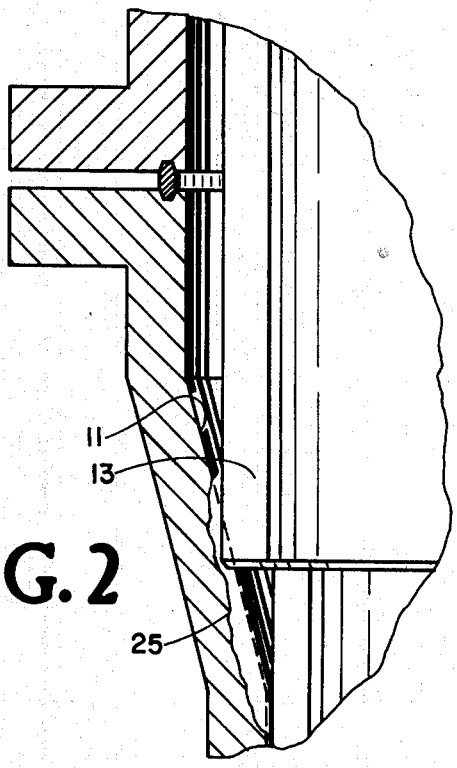
FIG. 2
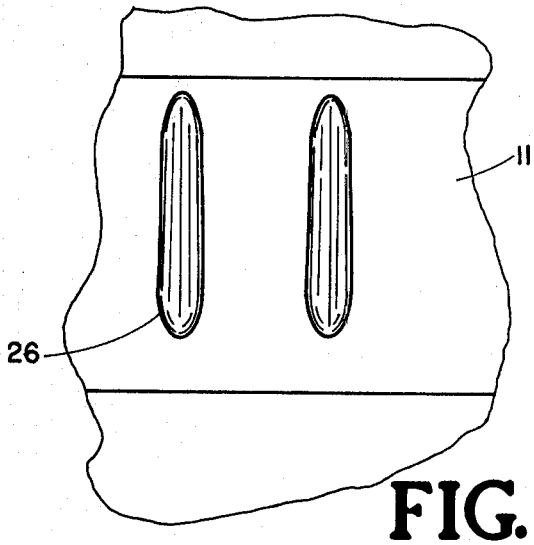
FIG. 3

WEAR BUSHING

FIELD OF THE INVENTION

The present invention relates generally to equipment used on a wellhead of an oilwell during drilling operations. More particularly, the present invention relates to the protection of permanently mounted wellhead members from damage inflicted by drill string members that are passed through the wellhead members and from damage by abrasive particles within drilling mud, during drilling operations.

BACKGROUND OF THE INVENTION

The conventional practice of removably mounting blowout preventers upon casing heads so as to prevent blowouts during drilling operations requires that: the casing head have a lower bore substantially the same as the casing upon which it is mounted; the casing head have an enlarged upper bore to support a hanger for the next string of casing; that the drilling assembly temporarily mounted above the casing head have a bore at least as large as the upper enlarged bore of the casing so as to pass the casing hanger therethrough. Because the lower bore of the casing head is smaller than the bores above, a tapered shoulder known as a bowl connects the lower casing head bore and the enlarged upper bore of the casing head, the bowl being subject to damage by drill string members passing through the casing head bore. The bowl is used for support of a casing hanger required to suspend the next string of casing and is used for sealing the annulus around the next string of casing, in cooperation with the casing hanger. Therefore, it is most important that the bowl be protected from damage because a failure of the bowl to support and seal, can and has caused expensive and dangerous remedial action, and in some cases has caused blowouts, loss of the well and even loss of life.

Various devices have been used heretofore to guide the drill string members, such as retractable rams mounted within an additional head mounted above the casing head. However, because of the extra space requirements, the extra costs, and the extra connections that may leak, other alternatives have been tried that fit into the upper enlarged bore of the casing head, the rings having relatively small vertical slots around their periphery so as to allow for the passage of returning drilling mud. Such small slots however, result in too high a velocity of upwardly flowing drilling mud returning from the well bore as when the rig is substantially blocked when passing a tool joint. Because the returning drilling mud contains extremely hard and abrasive particles cut from the formation being drilled and because it is flowing at high velocity through the small slots of the ring, the bowl often becomes cut such that it is rendered useless for sealing or for support purposes.

Applicant has found that: by providing an inner ring to guide the drill string members inwardly so as to prevent their contact with the bowl; by providing lugs around the ring for radial and vertical support of the ring against the bowl; by making the accumulative width of the lugs around the ring less than the accumulative width of the slots around the ring; that mud flow passages are formed large enough so as to reduce the mud velocity sufficiently to substantially eliminate the cutting of the bowl by the abrasive particles and to thereby preserve the sealing and support capability of the bowl.

Therefore, objects of the present invention are to: guide drill string members so as to prevent their contact with the bowl; prevent mechanical damage to the bowl; prevent cutting action of the bowl caused by high velocity flow of abrasive particles; preserve the sealing integrity of the bowl; preserve the support capability of the bowl; prevent replacement of expensive equipment; save rig time by preventing equipment replacement; prevent blowouts by maintaining sealing and support capabilities of the bowl.

These and other uses and advantages will become obvious to those skilled in the art upon practice of the present invention.

SUMMARY OF THE PRESENT INVENTION

The present invention comprises means to preserve the sealing and support capability of the bowl within a casing head bore, during drilling operations, against damage caused by contact with drill string members and by the high velocity flow of abrasive particles, such that the casing hanger for the next string of casing to be lowered into the well, can properly co-operate with the bowl to suspend the weight of the casing and to co-operate with the bowl so as to seal against the annulus formed around the next string of casing.

BRIEF DESCRIPTION OF THE DRAWINGS

FIG. 1 illustrates a fragmentary vertical section taken through line 1—1 of FIG. 4 showing a casing head having a wear bushing in place to guide a drill pipe tool joint.

FIG. 2 illustrates a fragmentary view of FIG. 1 and damage that may occur from drill pipe members when no wear bushing is used.

FIG. 3 illustrates a fragmentary view of the casing head bowl, taken along line 3—3 of FIG. 1 showing wash cuts that occur when wear bushings with insufficient slot flow area are used.

FIGS. 4–7 are top views of various configurations of wear bushings according to the present invention.

DESCRIPTION OF THE PREFERRED EMBODIMENTS

Wear bushing 10 as shown in FIG. 1 is positioned within bowl 11 of casing head 12 so as to guide drill string members as at 13 inwardly, so as to enter casing head minimum bore 14 without contacting bowl 11. Wear bushing 10 comprises guide surface 15 within ring 19 to contact member 13 so as to guide periphery 16 of member 13 inwardly to enter bore 17 of wear bushing 10, bore 17 being substantially the same diameter as bore 14 of head 12 which causes member 13 to pass through bore 14 without contacting bowl 11 and causing damage thereto as depicted in FIG. 2 at 25, FIG. 2 not including a wear bushing.

So as to position wear bushing 10 within bowl 11, lugs 18 are attached to outer surface 20 of ring 19, lugs 18 having surfaces 21 concentrically disposed with respect to bore 17 such that when wear bushing 10 is lowered through drilling equipment attached to casing head 12 as at 22, so as to allow surfaces 21 to contact bowl 11, wear bushing 10 is thereby positioned such that guide surface 15 and bore 17 are both concentrically and angularly aligned with bore 14 of casing head 12, such that drill string members as at 13 will be guided into bore 14 without contacting or damaging bowl 11.

FIG. 4 shows a top view of a general configuration of wear bushing 10 wherein three or more lugs 18 are equally spaced around the periphery of ring 19, such that when wear bushing 10 is positioned within bowl 11, flow slots 23 are formed by side surfaces 24 of lugs 19, surface 20 of ring 19 and bowl 11. In accord with the present invention, the cumulative width of flow slots around ring 19 is greater than the cumulative width of lugs around ring 19 such that a total flow area is provided so as to reduce the velocity of abrasive particles flowing through the slots, such that bowl 11 is not cut by the abrasive particles.

Should flow slots 23 be cut too small as practiced in prior art, the mud returning up the bore hole and the abrasive particles within the mud, would flow through the slots at a very high velocity which would cause a cutting action on bowl 11 as shown at 26 of FIG. 3 and would thereby prevent the use of bowl 11 to seal against or support a hanger for the next string of casing to be lowered within the well.

Other wear rings formed in accord with the present invention are shown in FIGS. 5–7, all having accumulative slot widths around the ring periphery greater than the respective accumulative width of the lugs around the periphery.

In the preferred embodiment of the invention, the wear bushing is comprised of a one piece construction although it is contemplated that the lugs may be formed separately from the ring and subsequently affixed so as to perform as hereinabove described. Further, in the preferred embodiment of the invention the wear bushing maybe made of a material harder than the material from which the casing head is made so as to improve the longevity of the wear bushing and reduce the frequency of replacement. Further, in the preferred embodiment of the invention the ring bore of the wear bushing may be so constructed or modified so as to be relatively harder than the lug members wherein this will again have a beneficial effect on the longevity and usefulness of the wear bushing.

It is therefore clear that the instant invention is well adapted to prevent damage to a casing head bowl by preventing contact with drill string members while at the same time, preventing damage to the casing head bowl by reducing the velocity of abrasive particles flowing across the bowl.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings are to be interpreted as illustrative and not in a limiting sense.

What is claimed is:

1. A wear bushing for use within the downwardly and inwardly tapering inner surface of a bowl section of a casing head bore during the drilling of an oilwell, comprising: a ring of metal or the like; the ring having a bore sufficient to pass drill string members therethrough; the ring bore being small enough to prevent the drill string members from contacting the casing head bore immediately below the ring; three or more lug members mounted on the periphery of the ring, said lug members defining a contact surface so constructed and arranged so as to cooperate with the tapering inner surface of the bowl section of the bore of the casing head for the purpose of supporting and centering the ring within the casing head bore; the accumulative width of the lugs being less than one half of the outer circumference of the ring.

2. The invention of claim 1 wherein the wear bushing is made of a material harder than the material from which the casing head is made.

3. The invention of claim 1 wherein the ring bore is harder than the lugs.

4. A removable wear bushing for guiding drill string members through a casing head and for channelling the upward flow of drilling fluids, including:

(a) a rigid integral body having an internal bore therethrough, said bore being at least as great in diameter as the drill string members, said bore diameter being sufficiently small enough to prevent the drill pipe members from contacting the inner surface of the casing head adjacent the wear bushing;

(b) said bore further including an upwardly expanding guide portion, so as to engage and guide the drill string member into the main portion of the bore;

(c) an outer periphery comprised of three or more lug members adapted so as to engage the inner surface of the casing head so as to position and support the wear bushing within the casing head so as to enable it to guide drill string members, said lug members defining circumferentially spaced flow slots between said lug members so as to permit the upward flow of drilling fluid therethrough, the circumferential distance defined by the flow areas being at least as great as that of the lug members, whereby the flow of drilling fluid through said flow areas is sufficiently slowed so as to prevent abrasive damage to the interior of the casing head, wherein the outer circumference of the wear bushing defines a frusto conical contact surface for engaging the interior of a like shaped bowl portion of the casing head.

5. The wear bushing of claim 4, wherein the wear bushing is constructed of material harder than the material from which the casing head is made.

6. The wear bushing of claim 4, wherein the bore is constructed of a material harder than the lug members.

* * * * *